US008503907B2

(12) United States Patent
Ji et al.

(10) Patent No.: US 8,503,907 B2
(45) Date of Patent: Aug. 6, 2013

(54) IMAGE FORMING APPARATUS, METHOD OF HANDLING THE IMAGE FORMING APPARATUS, AND METHOD OF PACKAGING THE IMAGE FORMING APPARATUS

(75) Inventors: Min-Sik Ji, Seoul (KR); Jai-Il Choi, Suwon-si (KR); Jun-Hee Lee, Suwon-si (KR); Jong-In Kim, Suwon-si (KR); Sang-Hoon Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 412 days.

(21) Appl. No.: 12/782,229

(22) Filed: May 18, 2010

(65) Prior Publication Data

US 2010/0316409 A1 Dec. 16, 2010

(30) Foreign Application Priority Data

Jun. 10, 2009 (KR) ..... 10-2009-0051518

(51) Int. Cl.
*G03G 21/16* (2006.01)
*G03G 15/04* (2006.01)

(52) U.S. Cl.
USPC ..... 399/111; 399/119

(58) Field of Classification Search
USPC ..... 399/113, 116, 119
See application file for complete search history.

(56) References Cited

U.S. PATENT DOCUMENTS

| | | | | |
|---|---|---|---|---|
| 7,463,844 | B2 * | 12/2008 | Hashimoto et al. | 399/111 |
| 2006/0239711 | A1 | 10/2006 | Hymas et al. | |
| 2006/0245785 | A1 * | 11/2006 | Kawamura et al. | 399/111 |
| 2007/0053717 | A1 | 3/2007 | Kweon | |

FOREIGN PATENT DOCUMENTS

| | | |
|---|---|---|
| JP | 07-234552 | 9/1995 |
| KR | 10-0693338 | 3/2007 |

OTHER PUBLICATIONS

European Search Report issued Oct. 5, 2010 in EP Application No. 10161655.5.

* cited by examiner

*Primary Examiner* — David Gray
*Assistant Examiner* — Gregory H Curran
(74) *Attorney, Agent, or Firm* — Stanzione & Kim, LLP

(57) ABSTRACT

Disclosed are an electrophotographic image forming apparatus including a detachable development cartridge having arranged therein a photoconductive drum and a developing roller for forming a toner image through a development nip formed between the photoconductive drum and the developing roller. The development cartridge may include a development nip control member that can switch between a first position, in which the development nip control member causes the photoconductive drum to be separated from the developing roller, and a second position, in which the development nip control member causes the photoconductive drum to be in a pressing contact with the developing roller so as to form therebetween the development nip. The development cartridge may be mounted in the main body of the electrophotographic image forming apparatus with its development nip control member being in the first position, separating the photoconductive member from the developing roller. The electrophotographic image forming apparatus may be packaged for distribution with the development cartridge received in the main body thereof where the photoconductive drum and the developing roller are no in contact with each other in the development cartridge as packaged.

19 Claims, 10 Drawing Sheets

IMAGE FORMING APPARATUS, METHOD OF HANDLING THE IMAGE FORMING APPARATUS, AND METHOD OF PACKAGING THE IMAGE FORMING APPARATUS

CROSS-REFERENCE TO RELATED PATENT APPLICATION

This application claims the benefit of Korean Patent Application No. 10-2009-0051518, filed on Jun. 10, 2009, in the Korean Intellectual Property Office, the disclosure of which is incorporated herein by reference in its entirety.

TECHNICAL FIELD

The present disclosure relates generally to an electrophotographic image forming apparatus having a detachable development cartridge, and, more particularly to a method of handling the electrophotographic image forming apparatus, and a method of packaging the same.

BACKGROUND OF RELATED ART

In a so-called electrophotographic image forming apparatus, an image is printed on a recording medium through several processes, which may include irradiating light, which is modulated with image information, onto a photoconductor to thereby form an electrostatic latent image as a pattern of potential differences between exposed and non-exposed portions on the surface of the photoconductor, supplying toner to the electrostatic latent image to thereby develop the electrostatic latent image into a visible toner image, transferring and fixing the toner image onto the recording medium.

The photoconductor and the toner may be provided in the form of a replaceable cartridge, typically and herein referred to as a 'development cartridge'. When the toner contained in the development cartridge is exhausted, the development cartridge may be removed from the electrophotographic image forming apparatus, and may be replaced with a new replacement or may be reinstalled after being replenished with a supply of toner. Such development cartridge also includes a developing roller for supplying the toner to the electrostatic latent image formed on the photoconductor. When a so-called contact type development is employed, the developing roller operable in a pressing contact with the photoconductor so as to forms a development nip.

Such development cartridge is typically provided as separate item, detached from the image forming apparatus when delivered to a consumer.

SUMMARY OF DISCLOSURE

According to an aspect of the present disclosure, there is provided an electrophotographic image forming apparatus having a development cartridge detachably received in a main body thereof for forming a toner image through a development nip formed by a pressing contact between a photoconductive member and a developing roller each arranged in the development cartridge. The electrophotographic image forming apparatus may include a development nip control member and a position switching member. The development nip control member may be moveably arranged on the development cartridge such that the development nip control member is moveable between a first position and a second position, and may cause the photoconductive member to be separated from the developing roller when the development nip control member is in the first position, and to be in contact with each other to thereby form the development nip therebetween when the development nip control member is in the second position. The position switching member may be arranged in the main body such that the position switching member interferes with the development nip control member to thereby cause the development nip control member to move from the first position to the second position when the development cartridge is detached from the main body.

The position switching member may be arranged so as not to interfere with the development nip control member when the development nip control member is in the second position.

The position switching member may be movable to a retracted position due to an interfering contact with the development nip control member that is in the first position when the development cartridge is received into the main body, the position switching member not causing the development nip control member to move to the second position when the position switching member moves to the retracted position.

The position switching member may return to an original position from the retracted position when the position switching member is no longer in the interfering contact with the development nip control member.

The development nip control member may comprise an outer circumferential portion, an inner circumferential portion and a lever portion. The outer circumferential portion may be rotatably supported on the development cartridge. A rotational shaft of the photoconductive member may be coupled to the inner circumferential portion. The respective radial centers of the inner circumferential portion and the outer circumferential portion may be spaced apart from each other. The lever portion may extend from the outer circumferential portion, and may be configured to come into the interfering contact with the position switching member when the development nip control member is in the first position.

The position switching member may comprise an operating arm and a stopper. The operating arm may be rotatably mounted in the main body, and may be arranged so as to come into the interfering contact with the lever portion of the development nip control member that is in the first position. The stopper may be configured to block the rotation of the operating arm in the direction of urging by the development nip control member that is in the first position when the development cartridge is being detached from the main body so as to cause the development nip control member to move from the first position to the second position.

The position switching member may further or alternatively comprise an operating arm and an elastic member. The operating arm may be movably supported in the main body so as to be movable between the retracted position and a switch position, at which switch position the operating arm interferes with the development nip control member that is in the first position so as to cause the development nip control member to move from the first position to the second position. The elastic member may be configured to elastically bias the operating arm to move toward the switch portion. The operating arm may include a retraction portion arranged to come into the interfering contact with the development nip control member that is in the first position when the development cartridge is being received into the main body so as to cause the operating arm to move to the retraction position in response to the interfering contact between the retraction portion and the development nip control member. The operating arm may further include a switch portion arranged to interfere with the development nip control member that is in the first position when the development cartridge is being detached from the main body so as to cause the operating arm to be in the switch position to thereby cause the development nip control member to move from the first position to the second position.

According to another aspect of the present disclosure, an electrophotographic image forming apparatus that may have a development cartridge detachably received in a main body thereof for forming a toner image through a development nip formed by a pressing contact between a photoconductive member and a developing roller each arranged in the development cartridge may be provided to include a holder and an operating arm. The holder may support thereon the rotational shaft of the photoconductive member, and may be rotatably supported in the development cartridge so as to be rotatable eccentrically with respect to the rotation shaft of the photoconductive member. The holder may be rotatable between a first position and a second position. The holder may cause the photoconductive member and the developing roller to be separated from each other when the holder is in the first position. The holder may allow the photoconductive member and the developing roller to be in contact with each other to thereby form the developing nip therebetween when the holder is in the second position. The operating arm may be arranged in the main body so as to be movable between a switch position, at which position the operating arm being in an interfering contact with the holder when the operating arm is in the switch position so as to cause the holder to switch its position from the first position to the second position, and a retraction position away from the switch position.

The operating arm may move to the retraction position away from the switch position in response to an interference with the holder when the development cartridge is received into the main body.

The electrophotographic image forming apparatus may further comprise an elastic member elastically biasing the operating arm toward the switch position.

When the development cartridge is detached from the main body, the operating arm may be retained in the switch position so as to interfere with the holder to thereby cause the holder to switch its position from the first position to the second position.

The electrophotographic image forming apparatus may further comprise a stopper that prevents the operating arm from moving away from the switch position when the development cartridge is detached from the main body.

According to yet another aspect of the present disclosure, a method of handling an electrophotographic image forming apparatus having a development cartridge detachably receivable into a main body thereof for forming a toner image through a development nip formed by a pressing contact between a photoconductive member and a developing roller arranged in the development cartridge may comprise the steps of: providing a development nip control member in the development cartridge, the development nip control member being moveable between a first position and a second position, the photoconductive member and the developing roller not contacting each other when the development nip control member is in the first position, the photoconductive member and the developing roller being in contact with each other to thereby form therebetween the development nip when the development nip control member is in the second position; and mounting the detachable development cartridge to the electrophotographic image forming apparatus with the development nip control member in the first position so that the photoconductive member and the developing roller of the development cartridge properly mounted in the main body of the electrophotographic image forming apparatus do not contact each other.

The method may further comprise the steps of: detaching the development cartridge from the main body in such a manner the development nip control member switches its position from the first position to the second position during the detachment so that the photoconductive member and the developing roller contact each other to form the development nip; and remounting the development cartridge into the main body with the development nip control member positioned in the second position in such a manner retaining the development nip between the photoconductive member and the developing roller.

The steps of detaching and remounting of the development cartridge may be performed prior to operating the electrophotographic image forming apparatus with the development cartridges for the first time.

The method may further comprise providing a position switching member arranged in the main body of the electrophotographic image forming apparatus in such a manner that the position switching member interferes with the development nip control member when the development nip control member is in the first position and that the position switching member does not interfere with the development nip control member located in the second position.

The position switching member may be moveable to a retracted position by an interference with the development nip control member that is in the first position when the development cartridge is received into the main body so as to not cause the development nip control member to move to the second position.

The position switching member may return to an original position from the retracted position when the position switching member is no longer interfered by the development nip control member.

The method may further comprise packaging the main body and the development cartridge received in the main body with the development nip control member positioned in the first position together as a unit.

According to even yet another aspect of the present disclosure, a method of packaging an electrophotographic image forming apparatus having a development cartridge detachably receivable into a main body thereof for forming a toner image through a development nip formed by a pressing contact between a photoconductive member and a developing roller arranged in the development cartridge may be provided to include the steps of: mounting the development cartridge into the main body of the electrophotographic image forming apparatus in such a manner that the photoconductive member and the developing roller of the development cartridge are not in the pressing contact with each other so that no development nip is formed therebetween; and packaging together as a unit the main body and the development cartridge received in the main body with no development nip formed in the development cartridge.

BRIEF DESCRIPTION OF THE DRAWINGS

Various features and advantages of the present disclosure will become apparent and more readily appreciated from the following description of several embodiments thereof, taken in conjunction with the accompanying drawings, of which.

DETAILED DESCRIPTION OF SEVERAL EMBODIMENTS

Figure 1:
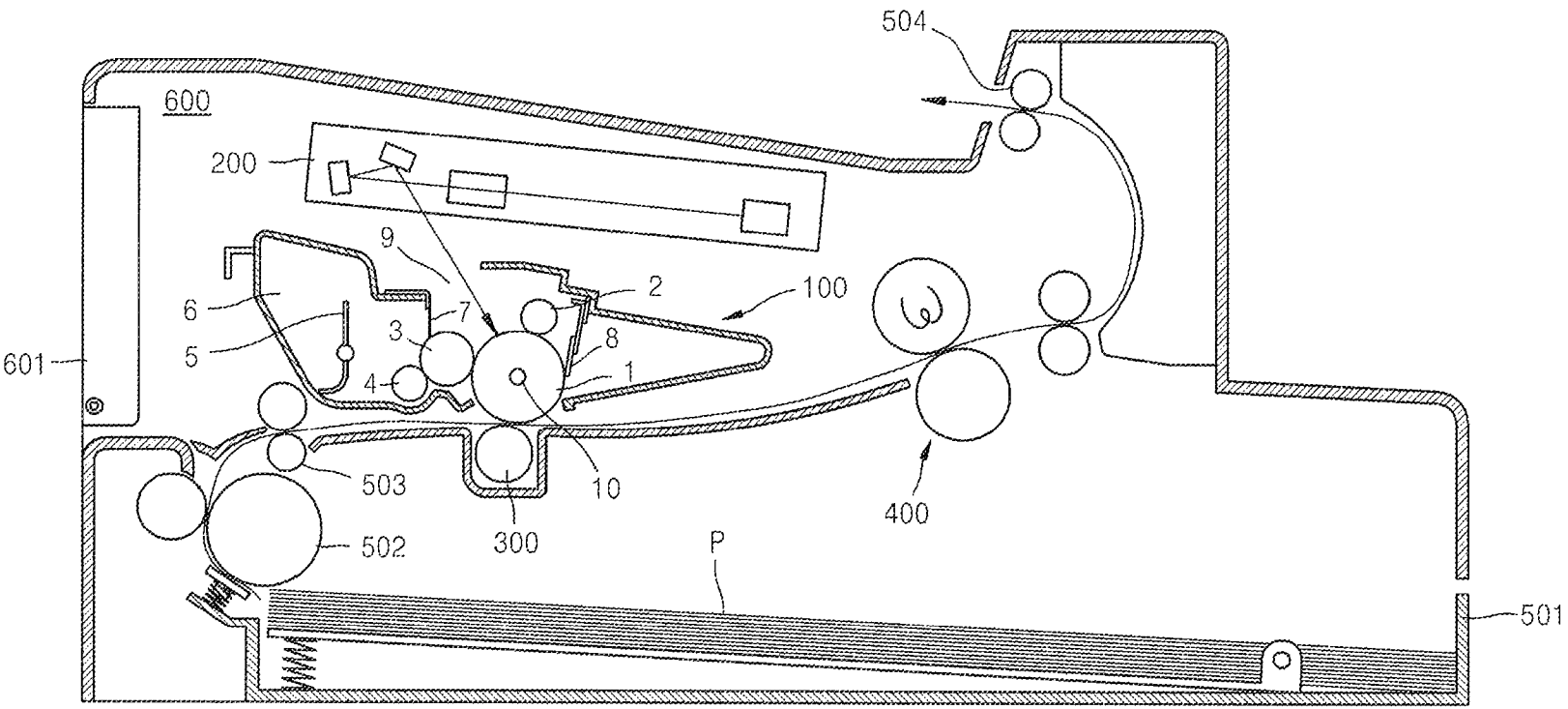
FIG. 1 is a schematic drawing showing the configuration of an electrophotographic image forming apparatus according to an embodiment of the present disclosure.

Reference will now be made in detail to several embodiments, examples of which are illustrated in the accompanying drawings, wherein like reference numerals refer to like elements throughout, repetitive descriptions of which may be omitted. It should be also noted that in the drawings, the dimensions of the features are not intended to be to true scale and may be exaggerated for the sake of allowing greater understanding.

Figure 2:
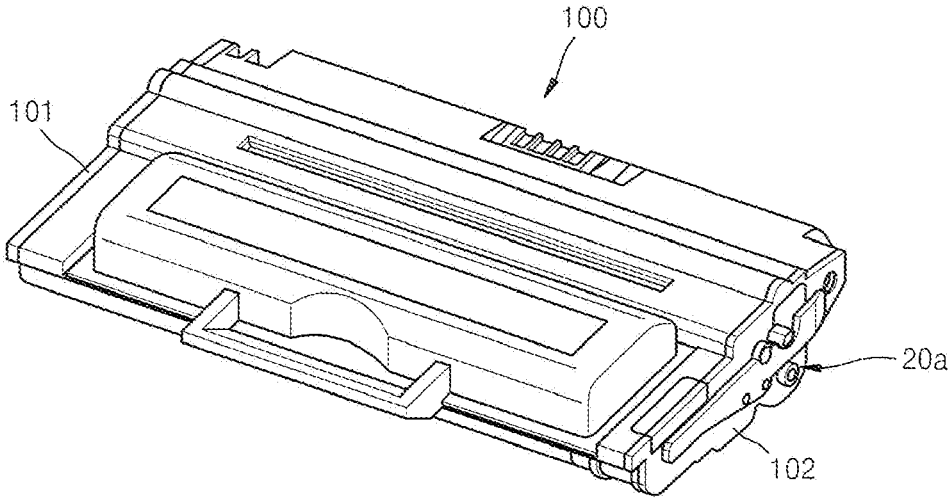
FIG. 2 is a perspective view of a development cartridge according to an embodiment of the present disclosure.

FIG. 1 illustrates a configuration of an electrophotographic image forming apparatus according to an embodiment of the present disclosure. FIG. 2 is a perspective view of a development cartridge according to an embodiment of the present disclosure. Referring to FIG. 1, the electrophotographic image forming apparatus according to an embodiment may include a development cartridge 100, an optical scanning unit 200, a transfer roller 300 and a fixing unit 400.

The development cartridge 100 may be detachably received in the main body 600 of the electrophotographic image forming apparatus. According to an embodiment, a door 601 may be provided in the main body 600; through which the development cartridge 100 may be accessible for mounting into or removal from the main body 600. The development cartridge 100 may include a photoconductive drum 1, a charging roller 2, a developing roller 3 and a toner container 6. The photoconductive drum 1 may include a layer of photoconductive material formed on the outer circumferential surface of a cylindrical metal pipe. The photoconductive drum 1, which is an example of a photoconductive member, may be supported on a rotational shaft 10 so as to be rotatable with the rotational shaft 10, which may in turn be supported in the development cartridge 100. The charging roller 2 may be an example of a charger, and may be operable to charge the surface of the photoconductive drum 1 to a uniform potential. To that end, a charging bias voltage may be applied to the charging roller 2. It should be noted that the charging roller 2 is merely an illustrative example of a charging device, and that other types of charging device, for example, a corona charger as is known to those skilled in the art may alternatively be used.

Figure 3:
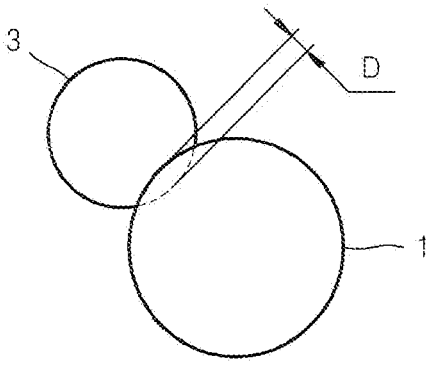
FIG. 3 illustrates a development nip.

The developing roller 3 may supply the toner contained in the toner container 6 to the surface of the photoconductive drum 1 to develop an electrostatic latent image formed thereon. According to an embodiment, a contact developing technique may be employed, in which the developing roller 3 and the photoconductive drum 1 are in a pressing contact with each other to thereby form a development nip D therebetween as shown in FIG. 3. To that end, the developing roller 3 may further include an elastic layer (not shown) formed on the outer circumferential surface of a conductive metal core (not shown). When a developing bias voltage is applied to the developing roller 3, the toner may be transferred via the development nip D to the surface of the photoconductive drum 1, and may selectively adhere thereto thereby developing the electrostatic latent image into a toner image.

The development cartridge 100 may further include a supply roller 4 that conveys the toner contained in the toner container 6 to the developing roller 3. A supply bias voltage may be applied to the supply roller 4 to facilitate the transfer of toner from the supply roller 4 to the developing roller 3. The development cartridge 100 may further include an agitator 5 that causes a movement of the toner contained in the toner container 6 toward the supply roller 4. The agitator 5 may also operate to agitate or stir the toner contained in the toner container 6, and may in the process frictionally charge the toner. The development cartridge 100 may further include a regulator 7, which may be arranged to be in contact with a surface of the developing roller 3, and which thereby operates to regulate the amount of toner supplied to the development nip D. The development cartridge 100 may further include a cleaning member 8 that operates to remove the residual toner remaining on the surface of the photoconductive drum 1 after a toner image is transferred to a recording medium P.

The optical scanning unit 200 may be operable to form an electrostatic latent image, and to that end, may scanning light that is modulated according to the image information, across the surface of the photoconductive drum 1, which surface had been charged to a uniform potential level by the charging roller 2. As a result of such light exposure, an electrostatic latent image is formed as a pattern of electrical potential difference between exposed and non-exposed portions of the surface of the photoconductive drum 1. An example of the optical scanning unit 200 may be a laser scanning unit (LSU) that scans light emitted from a laser diode across the photoconductive drum 1 in a main scanning direction by deflecting the light with a rotating polygon mirror.

The transfer roller 300 may be arranged to opposingly face the photoconductive drum 1, and may be in a pressing contact with the photoconductive drum 1 so as to form a transfer nip therebetween. For facilitating the transfer of the toner image from the photoconductive drum 1 to the recording medium P as the recording medium P passes through the transfer nip between the photoconductive drum 1 and the transfer roller 300, a transfer bias voltage may be applied to the transfer roller 300. As would be readily understood by those skilled in the art, other types of transfer device, for example, a corona type transfer device, may be used as an alternative to the transfer roller 300.

The toner image transferred to the surface of the recording medium P by the transfer unit 300 remains adhered to the surface of the recording medium P due to electrostatic attraction. The fixing unit 400 applies heat and pressure to permanently fix the toner image onto the recording medium P as the recording medium moves past the fixing unit 400.

An illustrative example of the image forming operation in an electrophotographic image forming apparatus having the above configuration will now be briefly described. When a charge bias voltage is applied to the charging roller 2, the photoconductive drum 1 is charged to a uniform surface potential. The optical scanning unit 200 scans light that is modulated according to image information onto the photoconductive drum 1 through an opening 9 of the development cartridge 100, thereby forming an electrostatic latent image on the surface of the photoconductive drum 1. The toner contained in the toner container 6 is supplied and attached to the surface of the developing roller 3 by the agitator 5 and the supply roller 4. The regulator 7 forms a toner layer having a uniform thickness on the surface of the developing roller 3. A developing bias voltage is applied to the developing roller 3. The toner that has moved to the development nip D as the developing roller 3 rotates is transferred and attached to the electrostatic latent image on the surface of the photoconductive drum 1 due to the developing bias voltage. As a result, a visible toner image is formed on the surface of the photoconductive drum 1.

A recording medium P picked up from a recording medium tray 501 by a pick-up roller 502 is transported to the transfer nip between the transfer roller 300 and the photoconductive drum 1 by a transporting roller 503. When a transfer bias voltage is applied to the transfer roller 300, the toner image formed on the photosensitive drum 1 is transferred to the recording medium P by an electrostatic attraction. The toner image transferred to the recording medium P is fixed to the recording medium P by being subjected to heat and pressure applied by the fixing unit 400, and thus completing the printing operation. Finally, the recording medium P bearing the image is discharged to the outside by a discharge roller 504. The residual toner on the surface of the photoconductive drum 1 remaining untransferred to the recording medium P is removed by the cleaning member 8.

As illustrated in FIG. 3, the development nip D may be defined as the degree or the extent of overlapping between, for example, the surfaces of the photoconductive drum 1 and developing roller 3. In a contact developing technique, the quality of images can be significantly affected by a variation in the development nip. An image forming apparatus may be purchased by a consumer, and may be delivered to the customer in such state where the photoconductive drum 1 and the developing roller 3 in the development cartridge 100 may be in a pressing contact with each other. In such case, as it could take a considerable amount of time from time of manufacture to the time of the purchase, the prolonged pressing contact with the photoconductive drum 1 in non-operating condition may result in the deformation of the developing roller 3, which in turn may result in a change in the development nip D. Further, the toner that may be trapped in the development nip D for a prolonged time may even become fixed or stuck to either the developing roller 3 or the photoconductive drum 1, which may result in the appearance of streaks in the image.

As a known attempt to address the above described problems, some of the development cartridge may be packaged separately from the main body of the image forming apparatus in a state where the developing roller does not contact the photoconductive drum in such separately packaged development cartridge at the time of purchase by a user. Under such scheme, when the user installs the separately provided development cartridge in the main body of the image forming apparatus, the developing roller and the photoconductive drum are brought into contact with each other to thereby form the development nip. While this approach does address the problem of developing roller deformation, because it is not possible to keep the developing roller separated from the photoconductive drum once the development cartridge is mounted into the main body of the image forming apparatus, the main body of the image forming apparatus and the development cartridge necessarily are distributed in separate packages, resulting in the increase in the complexity and cost of packaging and/or distribution logistics.

According to an aspect of the present disclosure, an electrophotographic image forming apparatus may be packaged together with the development cartridge 100 in a single package, and to that end may allow the separation between the photoconductive drum 1 and the developing roller 3 of the development cartridge 100 that is mounted in the main body 600. That is, for example, the photoconductive drum 1 and the developing roller 3 may be separated from each other when the development cartridge 100 is initially mounted into the main body 600 at the factory, and may be made to contact each other upon removal of the development cartridge 100 from the main body 600 by the consumer, thereby resulting in the development nip D. Then, when the development cartridge 100 is remounted into the main body, it may retain the development nip D, and may thus be ready to form an image.

Figure 4:
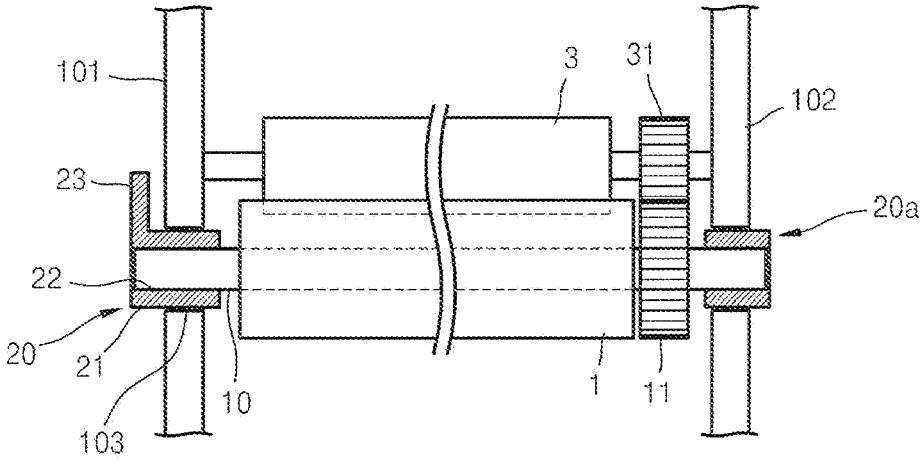
FIG. 4 is a diagram of a development nip control member according to an embodiment of the present disclosure.

Referring to FIG. 4, the developing roller 3 may be rotatably coupled to the opposite sidewalls 101 and 102 of the development cartridge 100. The photoconductive drum 1 may be coupled to and rotate with a rotation shaft 10, ends of which are supported on the opposite sidewalls 101 and 102. Gears 31 and 11 that rotate the developing roller 3 and the photoconductive drum 1, respectively, are engaged with each other. One of the gears 31 and 11 may be connected to a driving motor (not shown) provided in the main body 600 directly or indirectly through a gear train (not shown) when the development cartridge 100 is mounted into the main body 600.

According to an embodiment, the position of the developing roller 3 may be fixed while the photoconductive drum 1 is capable of moving toward and away from the developing roller 3 so as to be in contact with or to be separated from the developing roller 3. To this end, the electrophotographic image forming apparatus according to an embodiment of the present disclosure may include a development nip control member and a position switching member. The development nip control member, which is mounted in the development cartridge 100, may be moveable between a first position, at which the development nip control member separates the photoconductive drum 1 from the developing roller 3, and a second position, at which the development nip control member causes the photoconductive drum 1 to be in contact with the developing roller 3.

The position switching member, which is mounted in the main body 600, may interfere with the development nip control member so as to cause the development nip control member to move from the first position to the second position during when the development cartridge 100 is being detached from the main body 600. The position switching member may be devised so as not to interfere with the development nip control member that is in the second position. Further, during when the development cartridge 100 is being mounted into the main body 600, the position switching member may be moved by an interfering contact with the development nip control member that is in the first position to a retracted position without causing the movement of the development nip control member into the second position. Once the interfering contact with the development nip control member is released, the position switching member may return to the original position from a retracted position.

Figure 5:
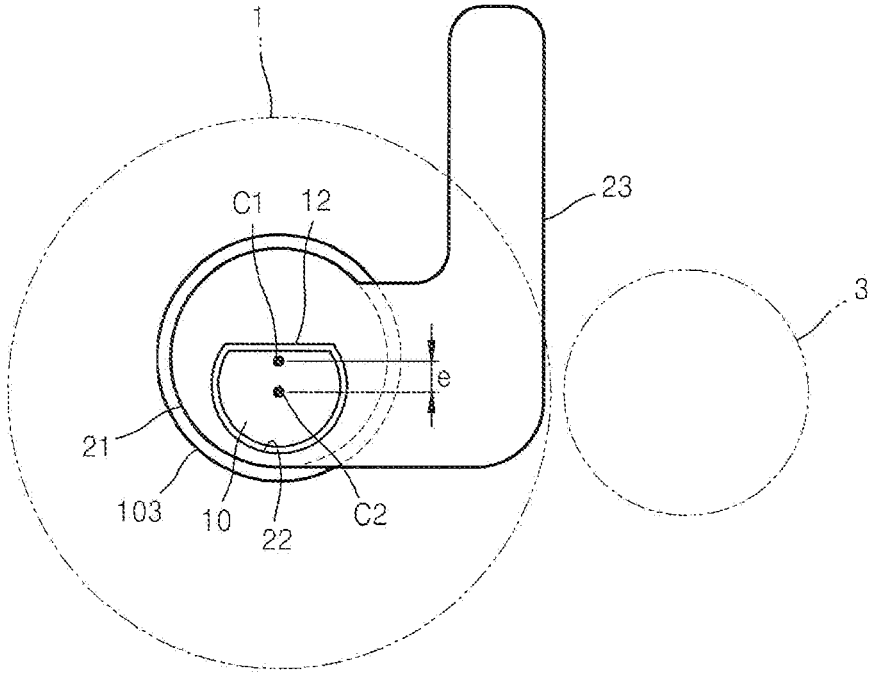
FIG. 5 illustrates a state where a holder illustrated in FIG. 4 is located in a first position.

In FIGS. 4 and 5, a holder 20 is illustrated as an example of the development nip control member. The holder 20 may include an outer circumference portion 21 that is received into an insertion hole 103 formed in the sidewall 101 of the development cartridge 100, an inner circumference portion 22 into which an end of the rotational shaft 10 is received and a lever portion 23 that extends from the outer circumference portion 21. The holder 20 may be rotatable within the insertion hole 103.

As illustrated in FIG. 5, an end of the rotational shaft 10 may have a chamfer portion 12. The inner circumference portion 22 may have a shape corresponding to the shape of the chamfer end portion 12 of the rotational shaft 10. The correspondingly shaped end portion 12 of the rotational shaft 10 and the inner circumference portion 22 may be securely coupled to each other, for example, by tight fitting. Thus, the rotational shaft 10 rotates when the holder 20 is rotated. It should be noted that the coupling structure of the inner circumference portion 22 and the rotational shaft 10 is not limited to that described above, and that any structure that allows the holder 20 and the rotational shaft 20 to rotate together may be used.

Since the rotational shaft 10 rotates together with the holder 20, the lever portion 23 may not be necessary for the holder 20*a* arranged on the sidewall 102 for supporting the opposite end of the rotational shaft 10, and may thus include only the inner circumference portion 22 and the outer circumference portion 21.

Figure 6:
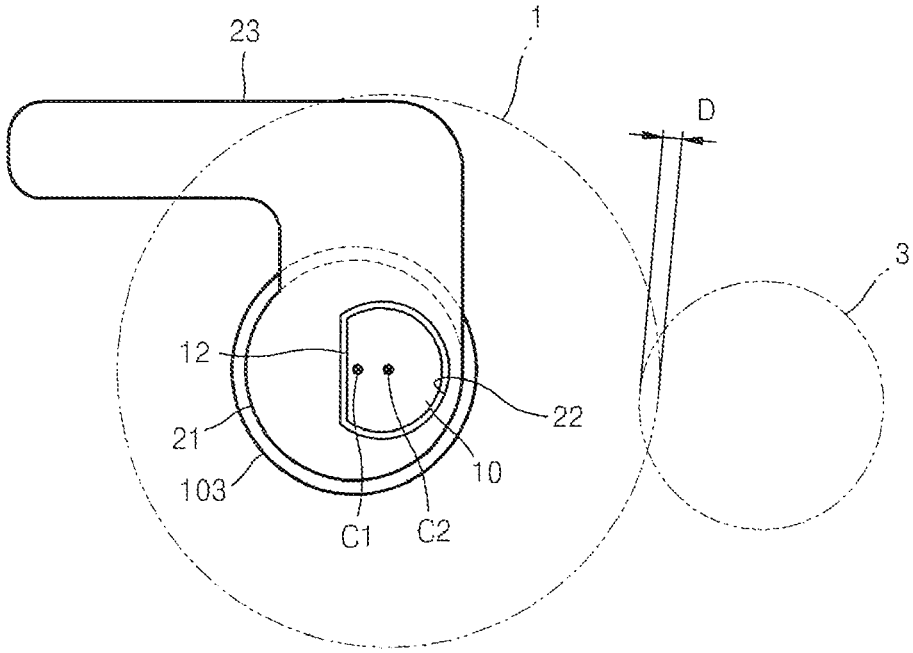
FIG. 6 illustrates a state where the holder illustrated in FIG. 4 is located in a second position.

According to an embodiment, the center C2 of the inner circumference portion 22 may be located eccentrically with respect to the center C1 of the outer circumference portion 21. FIG. 5 illustrates a state where the holder 20 is in the first position, i.e., at which the photoconductive drum 1 and the developing roller 3 are separated from each other. As shown in FIG. 5, when the holder 20 is in the first position, the center C2 of the inner circumference portion 22 is located below the center C1 of the outer circumference portion 21. From this state, if the holder 20 is rotated counterclockwise, for example, by 90 degrees, as illustrated in FIG. 6, the center C2 of the inner circumference portion 22 becomes positioned to the right of the center C1 of the outer circumference portion 21. When the holder 20 is in the second position as illustrated in FIG. 6, the photoconductive drum 1 contacts and presses against the developing roller 3, thus forming the development nip D. The degree of eccentricity (e) may determined the size of the development nip D. For example, according to the embodiment illustrated in FIGS. 5 and 6, the degree of eccentricity (e) may be equal to the size of the development nip D.

Figure 7:
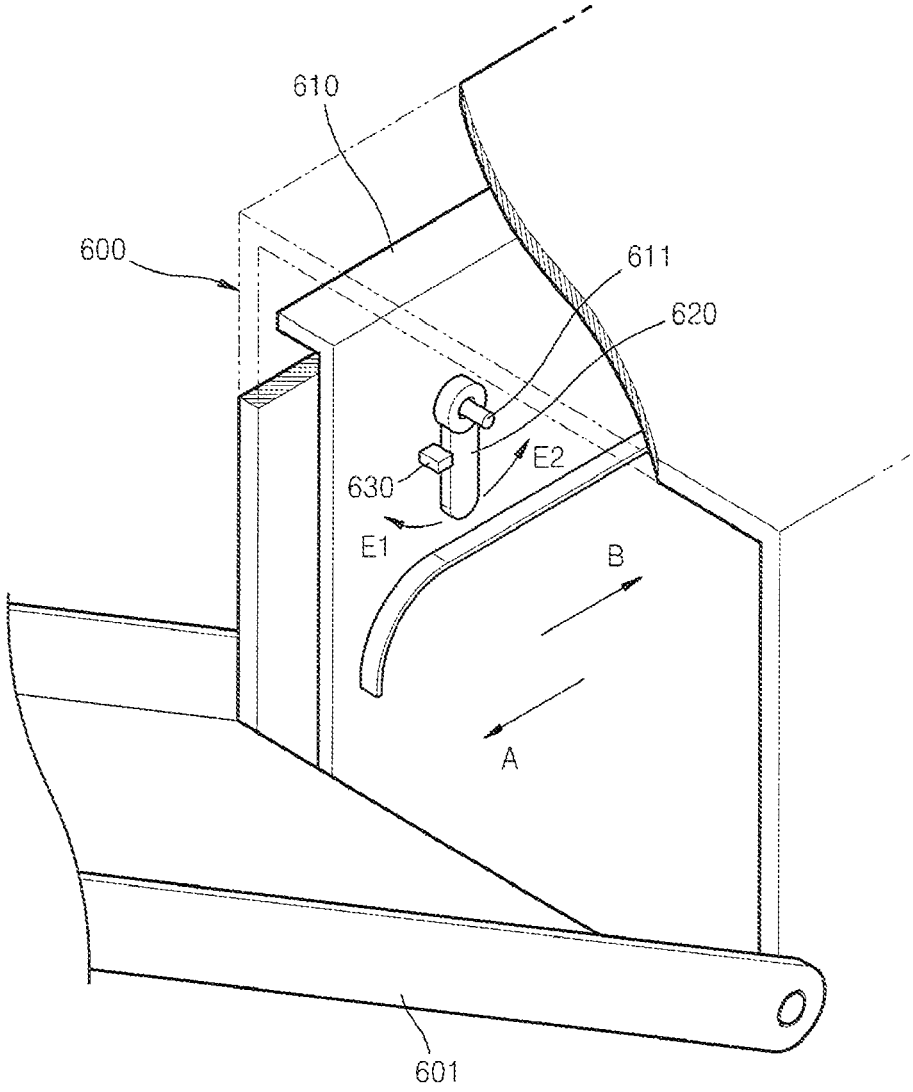
FIG. 7 is a diagram of a position switching member according to an embodiment of the present disclosure.

FIG. 7 illustrates an example of the position switching member. The position switching member may include an operating arm 620 that is rotatably supported in the main body 600 or in a frame 610 provided in the main body 600. The position switching member may also include a stopper 630 that restricts the rotation of the operating arm 620. The operating arm 620 may rotate between a switch position and a retracted position. When the operating arm 620 is in the switch position, it may interfere with, so as to move, the holder 20 that is in the first position so that the position of the holder 20 switches to the second position. The operating arm 620 may itself be moved to the retracted position by an interfering contact with the holder 20 without causing the holder 20 to switch its position.

For example, as shown in FIG. 7, the operating arm 620 may be coupled to, so as to rotate with, a shaft 611 provided on a frame 610 inside the main body 600. The operating arm 620 interferes with the lever portion 23 of the holder 20 that is in the first position (as shown in FIG. 5) when the development cartridge 100 is detached, i.e., when the development cartridge 100 moves in the direction A shown in FIG. 7. Because the stopper 630 blocks the operating arm 620 from rotating further in the direction E1, the operating arm 620 remains in the switch position, and thus continues to interfere with the holder 20, causing the holder 20 to rotate to the second position (as shown in FIG. 6).

On the other hand, the movement of the development cartridge 100 in the mounting direction B shown in FIG. 7, i.e., into the main body 600, with the holder 20 in the first position, results in the operating arm 620 interfering with the lever portion 23 of the holder 20, however in this case, the interference causes the operating arm 620 to rotate from the switch position in the direction E2 to a retracted position. Thus, the holder 20 is retained in the first position. Once the development cartridge 100 has moved sufficiently further in the mounting direction B, and when the holder 20 thus no longer interferes with the operating arm 620, according to an embodiment, the operating arm 620 may return to the original position by its own weight due to gravity. Alternatively, the operating arm 620 may be biased to return to the original position, for example, elastically with an elastic member (not shown).

Figure 8A:
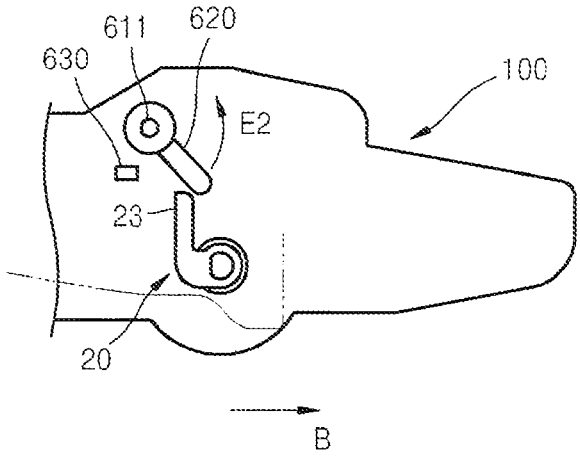
FIGS. 8A and 8B illustrate a process of mounting the development cartridge into a main body in a state where the holder is located in the first position.
Figure 8B:
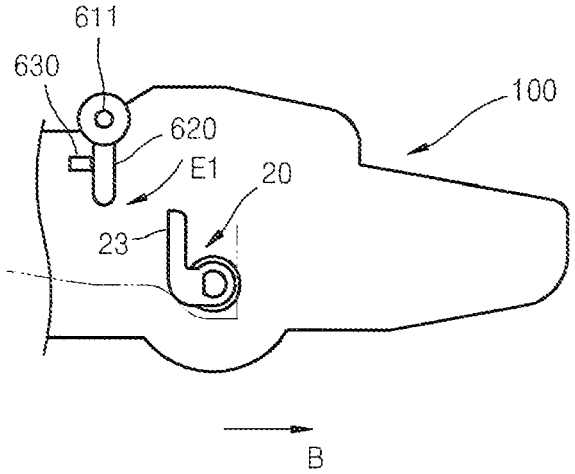

With the above described configuration, the development cartridge 100 may be mounted into the main body 600 of the image forming apparatus in the direction B in a state in which the holder 20 is located in the first position (as shown in FIG. 5). With the holder 20 being in the first state, as illustrated in FIG. 8A, although the lever portion 23 of the holder 20 interferes with the operating arm 620, the operating arm 620 is free to rotate, and is rotated about the shaft 611 in direction E2 by the lever portion 23 so that the holder 20 does not itself rotate, and remains in the first position. Thereafter, when development cartridge 100 moves further the in the direction B to release the operating arm 620, the operating arm 620 rotates in direction E1 due to gravity, and returns to the original position as illustrated in FIG. 8B, thus completing the mounting of the development cartridge 100. The image forming apparatus may be packaged and distributed in this state. Thus, packing costs may be reduced when compared to packaging the main body and the development cartridge in separate boxes or even to packaging the development cartridge separately from the main body within a single box. Logistics costs may also be reduced. In addition, according to an aspect of the present disclosure, since the photoconductive drum 1 is kept separated from the developing roller 3 during the distribution and/or warehousing, possible image quality deterioration that may be caused due to the deformation of the developing roller 3 or due to the adherence of toner to the photoconductive drum 1 and/or to the developing roller 3, which may result from prolonged storage of the image forming apparatus with the photoconductive drum in a pressing contact with the developing roller.

Figure 9A:
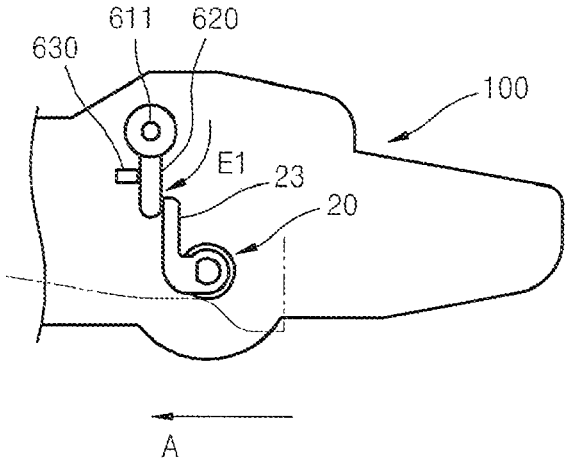
FIGS. 9A and 9B illustrate a process of detaching the development cartridge from the main body in the state where the holder is located in the first position.
Figure 9B:
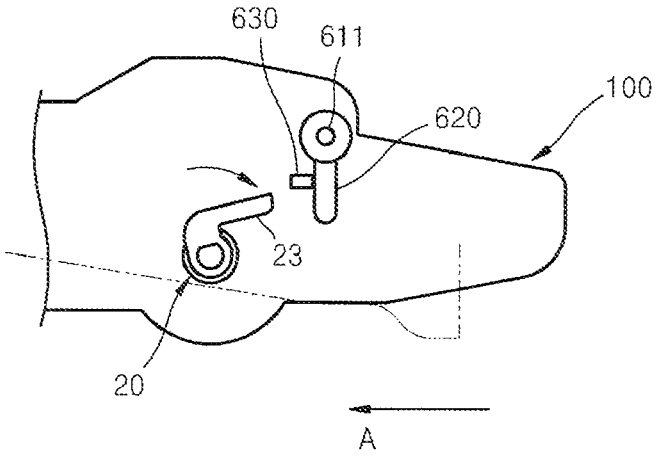

The development cartridge 100 may typically be provided with a protective film for protecting the photoconductive drum 1 and/or a separating film for separating the toner box (not shown) for supplying toner to the toner container 6. Before using the image forming apparatus for the first time, the user needs to remove such a protective or separation film from the development cartridge 100. To do so, the user may first detach the development cartridge 100 from the main body 600 before using the image forming apparatus for the first time. As illustrated in FIG. 9A, when the development cartridge 100 slides in direction A to be detached from the main body 600, the lever portion 23 of the holder 20 that is in the first position interferes with the operating arm 620. However, the stopper 630 blocks the operating arm 620 from rotating in the direction E1, resulting in the holder 20 rotating to the second position as illustrated in FIG. 9B. With the holder 20 moving to the second position, the photoconductive drum 1 comes into a contact with the developing roller 3 so as to form the development nip D as illustrated in FIG. 6. Then, for example, after the removal of the protective or separation film(s), the user may remount the development cartridge 100 into the main body 600. During the remount, since the holder 20 is in the second position, the operating arm 620 and the lever portion 23 do not interfere with each other. Thus, the photoconductive drum 1 and the developing roller 3 remain in contact with each other so that the development nip D is are retained. Accordingly, once the development cartridge 100 is properly remounted, the image forming apparatus may be ready to operate.

According to an aspect of the present disclosure, when the image forming apparatus is expected to be stored for a prolonged time, in order to allow such prolonged storage with the development cartridge 100 mounted in the main body 600 without the possible deformation of the developing roller 3 or the possibility of the toner being stuck in either the photoconductive drum 1 or the developing roller 3, the user may detach the development cartridge 100 from the main body 600, position the development nip control member, for example, the lever 23, in the first position, and then remount the development cartridge 100 in the main body 600 so that the photoconductive drum 1 and the developing roller 3 may be kept during the storage as separated from each other. In so doing, a less storage space may be necessary in comparison to storing the development cartridge 100 separately from the main body 600.

Figure 10:
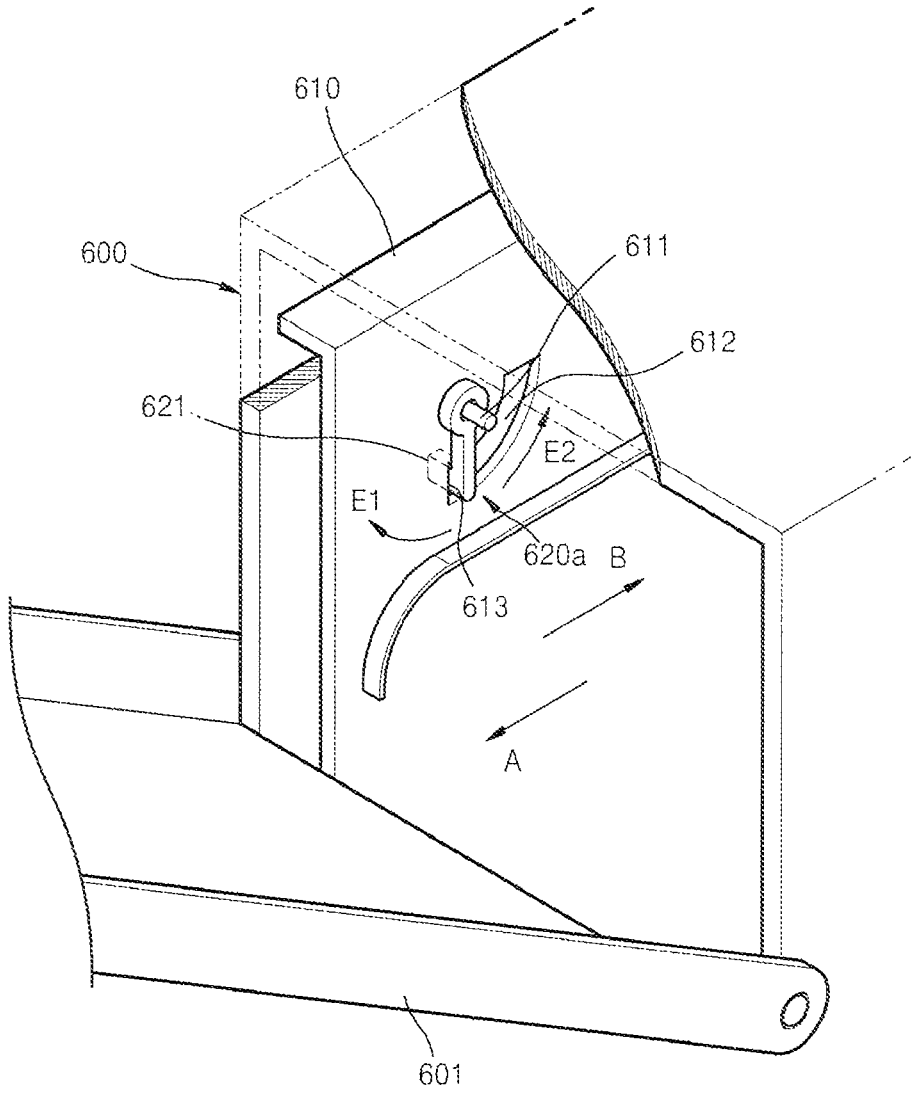
FIG. 10 is a diagram of a position switching member according to another embodiment of the present disclosure.

FIG. 10 illustrates another example of the position switching member. As illustrated in FIG. 10, an end of an operating arm 620*a* of a position switching member according to an embodiment may have a protruding portion 621. The protruding portion 621 may be inserted into a groove 612 formed in the frame 610. The operating arm 620*a* may be rotatable along the groove 612 in the direction E2. However, the rotation of the operating arm 620*a* in the direction E1 may be blocked by the interfering contact between the protruding portion 621 and the end 613 of the groove 612, and may thus be restricted. In this case, the protruding portion 621 and the end 613 of the groove 612 function as the stopper 630 of the embodiments previously described in reference to FIG. 7. According to an embodiment, as illustrated in FIG. 10, when the development cartridge 100 is slid in the direction B to be mounted into the main body 600 with the holder 20 is located in the first position (as shown in FIG. 5), the operating arm 620*a* interferes with the lever portion 23 of the holder 20, thereby causing the operating arm 620*a* to rotate in direction E2 and to retract away from the holder 20 so that the position of the holder 20 does not switch to the second position. On the other hand, when the development cartridge 100 is slid in the direction A to be detached from the main body 600 with the holder 20 in the first position, the protruding portion 621 of the operating arm 620*a* is blocked by the end 613 of the groove 612 so that the operating arm 620*a* is prevented from rotating in the direction E1. Thus, the operating arm 620*a* causes the holder 20 to rotate, thereby switching to the second position.

Figure 11:
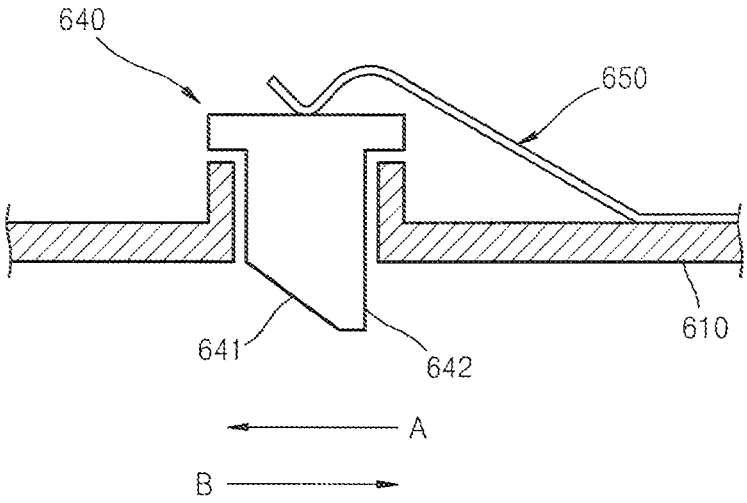
FIG. 11 is a diagram of a position switching member according to another embodiment of the present disclosure.
Figure 12:
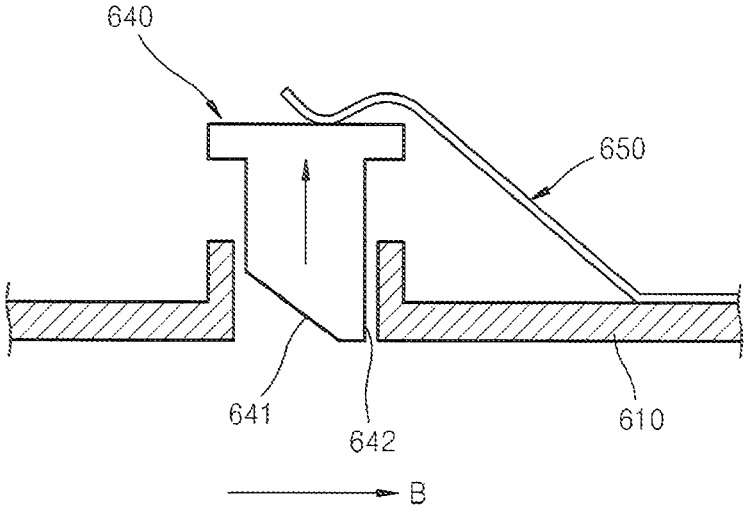
FIG. 12 illustrates a state where an operating arm illustrated in FIG. 11 is located in a retraction position.

FIGS. 11 and 12 illustrate yet another example of the position switching member. Referring to FIGS. 11 and 12, an operating arm 640 may be slidably coupled to the frame 610. The operating arm 640 may be disposed in the main body 600, for example, in the frame 610, to be moveable to a switch position (see FIG. 11) where the holder 20 located in the first position is switchable to the second position, or to a retraction position (see FIG. 12) where the position of the holder 20 does not switch. For example, the operating arm 640 may be slidable in a direction perpendicular to the detaching/mounting directions A and B. An elastic member 650 may be provided to apply an elastic force to elastically bias the operating arm 640 in the direction toward the switch position.

Figure 13:
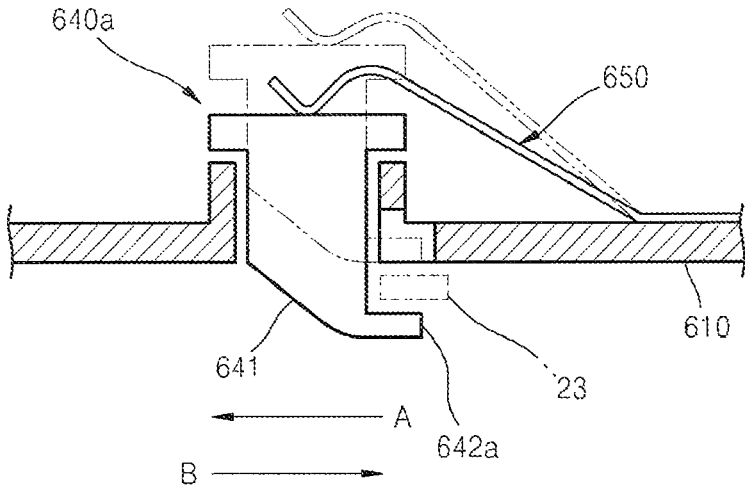
FIG. 13 illustrates an operating arm according to another embodiment of the present disclosure.

The operating arm 640 may include a retraction portion 641 and a switch portion 642. The retraction portion 641 may interfere with the holder 20 located in the first position when the development cartridge 100 is mounted so as to guide the operating arm 640 to be retreated to the retraction position. For example, the retraction portion 641 may include an inclined surface that is inclined with respect to the mount direction B of the development cartridge 100, that is, the retraction portion 641 may extend further towards the mount direction B. The switch portion 642 may interfere with the holder 20 that is in the first position when the development cartridge 100 is slid in the direction A to be detached so as to cause the holder 20 to be switched to the second position. For example, as shown in FIGS. 11 and 12, the switch portion 642 may be formed to be parallel to the direction along which the operating arm 640 moves. The shape of the switch portion 642 however is not limited to that shown in FIGS. 11 and 12. The switch portion 642 may have any shape that enables the operating arm 640 to be retained in the switch position illustrated in FIG. 11 even when the lever portion 23 of the development cartridge 100 interferes therewith as the development cartridge 100 moves in the direction A. For example, as illustrated in FIG. 13, a switch portion 642*a* may extend parallel to a frame 610 so that the lever portion 23 may be located between the switch portion 642*a* and the frame 610. In this example, since the switch portion 642*a* interferes with the lever portion 23, the operating arm 640*a* may not be allowed to retract into the retraction position.

With the above-described configuration, when, while the holder 20 is in the first position, the development cartridge 100 is slid in direction B to be mounted into the main body 600, the lever portion 23 and the retraction portion 641 interfere with each other so that the operating arm 640 or 640*a* is rotated to the retraction position as illustrated in FIG. 12, allowing the holder 20 to be retained in the first position. When the lever portion 23 and the retraction portion 641 no longer interfere with each other, the operating arm 640 or 640*a* returns to the switch position as illustrated in FIGS. 11 and 13 due to the elastic force of the elastic member 650. On the other hand, when the development cartridge 100 is slid in the direction A to be detached from the main body 600 with the holder 20 being in the first position, the switch portion 642 or 642*a* interferes with the lever portion 23, causing the operating arm 640 or 640*a* to be retained in the switch portion, but causing instead the holder 20 to be rotated and to thus to switch to the second position.

Figure 14:
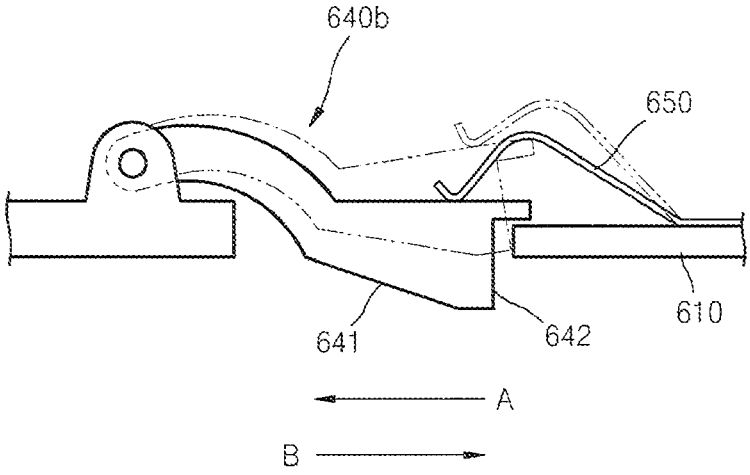
FIG. 14 illustrates an operating arm according to another embodiment of the present disclosure.

In the examples illustrated in FIGS. 11 through 13, the operating arm 640 or 640*a* are described as being coupled to the frame 610 in a linearly slidable manner. Alternatively, as illustrated in FIG. 14, an operating arm 640*b* may be rotatably coupled to the frame 610.

While the present disclosure has been particularly shown and described with reference to several embodiments thereof, it will be understood by those of ordinary skill in the art that various changes in form and details may be made thereto without departing from the principles and spirit of the present disclosure, the proper scope of which is defined in the following claims and their equivalents.

What is claimed is:

1. An electrophotographic image forming apparatus having a development cartridge detachably received in a main body thereof for forming a toner image through a development nip formed by a pressing contact between a photoconductive member and a developing roller each arranged in the development cartridge, the apparatus comprising:

a development nip control member moveably arranged on the development cartridge such that the development nip control member is moveable between a first position and a second position, the development nip control member causing the photoconductive member to be separated from the developing roller when the development nip control member is in the first position, the development nip control member allowing the photoconductive member to be in contact with the developing roller to thereby form the development nip therebetween when the development nip control member is in the second position; and a position switching member arranged in the main body such that the position switching member interferes with the development nip control member to thereby cause the development nip control member to move from the first position to the second position when the development cartridge is detached from the main body.

2. The electrophotographic image forming apparatus of claim 1, wherein the position switching member is arranged so as to not interfere with the development nip control member when the development nip control member is in the second position.

3. The electrophotographic image forming apparatus of claim 1, wherein the position switching member is movable to a retracted position due to an interfering contact with the development nip control member that is in the first position when the development cartridge is received into the main body, the position switching member not causing the development nip control member to move to the second position when the position switching member moves to the retracted position.

4. The electrophotographic image forming apparatus of claim 3, wherein the position switching member returns to an original position from the retracted position when the position switching member is no longer in the interfering contact with the development nip control member.

5. The electrophotographic image forming apparatus of claim 3, wherein the development nip control member comprises:

an outer circumferential portion that is rotatably supported on the development cartridge;

an inner circumferential portion to which a rotational shaft of the photoconductive member is coupled, respective radial centers of the inner circumferential portion and the outer circumferential portion being spaced apart from each other; and a lever portion that extends from the outer circumferential portion and that is configured to come into the interfering contact with the position switching member when the development nip control member is in the first position.

6. The electrophotographic image forming apparatus of claim 5, wherein the position switching member comprises:

an operating arm that is rotatably mounted in the main body and that is arranged so as to come into the interfering contact with the lever portion of the development nip control member that is in the first position; and a stopper configured to block a rotation of the operating arm in a direction of urging by the development nip control member that is in the first position when the development cartridge is being detached from the main body so as to cause the development nip control member to move from the first position to the second position.

7. The electrophotographic image forming apparatus of claim 3, wherein the position switching member comprises:

an operating arm movably supported in the main body so as to be movable between the retracted position and a switch position, at which switch position the operating arm interferes with the development nip control member that is in the first position so as to cause the development nip control member to move from the first position to the second position; and an elastic member configured to elastically bias the operating arm to move toward the switch portion, wherein the operating arm includes a retraction portion arranged to come into the interfering contact with the development nip control member that is in the first position when the development cartridge is being received into the main body so as to cause the operating arm to move to the retraction position in response to the interfering contact between the retraction portion and the development nip control member, and wherein the operating arm further includes a switch portion arranged to interfere with the development nip control member that is in the first position when the development cartridge is being detached from the main body so as to cause the operating arm to be in the switch position to thereby cause the development nip control member to move from the first position to the second position.

8. An electrophotographic image forming apparatus having a development cartridge detachably received in a main body thereof for forming a toner image through a development nip formed by a pressing contact between a photoconductive member and a developing roller each arranged in the development cartridge, comprising:

a holder supporting thereon a rotational shaft of the photoconductive member, the holder being rotatably supported in the development cartridge so as to be rotatable eccentrically with respect to the rotation shaft of the photoconductive member, the holder being rotatable between a first position and a second position, the holder causing the photoconductive member and the developing roller to be separated from each other when the holder is in the first position, the holder allowing the photoconductive member and the developing roller to be in contact with each other to thereby form the developing nip therebetween when the holder is in the second position, and an operating arm arranged in the main body so as to be movable between a switch position, at which position the operating arm being in an interfering contact with the holder when the operating arm is in the switch position so as to cause the holder to switch its position from the first position to the second position, and a retraction position away from the switch position.

9. The electrophotographic image forming apparatus of claim 8, wherein the operating arm moves to the retraction position away from the switch position in response to an interference with the holder when the development cartridge is received into the main body.

10. The electrophotographic image forming apparatus of claim 9, further comprising an elastic member elastically biasing the operating arm toward the switch position.

11. The electrophotographic image forming apparatus of claim 8, wherein, when the development cartridge is detached from the main body, the operating arm is retained in the switch position so as to interfere with the holder to thereby cause the holder to switch its position from the first position to the second position.

12. The electrophotographic image forming apparatus of claim 11, further comprising a stopper that prevents the operating arm from moving away from the switch position when the development cartridge is detached from the main body.

13. A method of handling an electrophotographic image forming apparatus having a development cartridge detachably receivable into a main body thereof for forming a toner image through a development nip formed by a pressing contact between a photoconductive member and a developing roller arranged in the development cartridge, comprising:

providing a development nip control member in the development cartridge, the development nip control member being moveable between a first position and a second position, the photoconductive member and the developing roller not contacting each other when the development nip control member is in the first position, the photoconductive member and the developing roller being in contact with each other to thereby form therebetween the development nip when the development nip control member is in the second position;

mounting the detachable development cartridge to the electrophotographic image forming apparatus with the development nip control member in the first position so that the photoconductive member and the developing roller of the development cartridge properly mounted in the main body of the electrophotographic image forming apparatus do not contact each other;

detaching the development cartridge from the main body in such a manner the development nip control member switches its position from the first position to the second position during the detachment so that the photoconductive member and the developing roller contact each other to form the development nip; and remounting the development cartridge into the main body with the development nip control member positioned in the second position in such a manner retaining the development nip between the photoconductive member and the developing roller.

14. The method of claim 13, wherein the steps of detaching and remounting of the development cartridge are performed prior to operating the electrophotographic image forming apparatus with the development cartridges for the first time.

15. The method of claim 13, further comprising:

providing a position switching member arranged in the main body of the electrophotographic image forming apparatus in such a manner that the position switching member interferes with the development nip control member when the development nip control member is in the first position and that the position switching member does not interfere with the development nip control member located in the second position.

16. The method of claim 15, wherein the position switching member is moveable to a retracted position by an interference with the development nip control member that is in the first position when the development cartridge is received into the main body so as to not cause the development nip control member to move to the second position.

17. The method of claim 16, wherein the position switching member returns to an original position from the retracted position when the position switching member is no longer interfered by the development nip control member.

18. The method of claim 13, further comprising:

packaging the main body and the development cartridge received in the main body with the development nip control member positioned in the first position together as a unit.

19. A method of packaging an electrophotographic image forming apparatus having a development cartridge detachably receivable into a main body thereof for forming a toner image through a development nip formed by a pressing contact between a photoconductive member and a developing roller arranged in the development cartridge, the method comprising:

in a state where the photoconductive member and the developing roller of the development cartridge are not in the pressing contact with each other so that no development nip is formed between, mounting the development cartridge into the main body of the electrophotographic image forming apparatus;

packaging together as a unit the main body and the development cartridge received in the main body with no development nip formed in the development cartridge;

detaching the development cartridge from the main body in such a manner that the photoconductive member and the developing roller contact each other to form the development nip; and remounting the development cartridge into the main body in such a manner retaining the development nip between the photoconductive member and the developing roller.

* * * * *